United States Patent [19]

Takahashi et al.

[11] Patent Number: 4,750,667

[45] Date of Patent: Jun. 14, 1988

[54] METHOD OF FORMING WEAR-RESISTANT LAYER

[75] Inventors: Sakae Takahashi, Mishima; Zenichi Mochizuki, Fuji; Fumihisa Yano; Mikiyoshi Miyauchi, both of Numazu, all of Japan

[73] Assignee: Toshiba Kikai Kabushiki Kaisha, Tokyo, Japan

[21] Appl. No.: 14,351

[22] Filed: Feb. 13, 1987

[30] Foreign Application Priority Data

Feb. 20, 1986 [JP] Japan ..... 61-36226

[51] Int. Cl.[4] ..... B23K 31/02

[52] U.S. Cl. ..... 228/178; 419/12

[58] Field of Search ..... 228/178, 248; 419/12, 419/13, 14, 27

[56] References Cited

U.S. PATENT DOCUMENTS 2,696,434 12/1954 Bartlett ..... 419/27

4,574,011 3/1986 Bonjour et al. ..... 419/12

FOREIGN PATENT DOCUMENTS 12286 4/1976 Japan ..... 419/12

210901 12/1982 Japan ..... 419/12

89503 5/1985 Japan ..... 419/14

*Primary Examiner*—M. Jordan

*Attorney, Agent, or Firm*—Stevens, Davis, Miller & Mosher

[57] ABSTRACT

A method whereby a base member having a surface on which a wear-resistant layer is formed and a mold member are disposed in opposing relation so as to form a gap between the surface of the base member and the surface of the mold member opposing the surface of the base member. Sintered hard substance grains of a hard substance powder such as material selected from carbides, nitrides and borides of metals belonging to groups IV, V and VI of the periodic table are filled in the aforementioned gap along the wear-resistant layer forming surface of the base member. A metal of self-melting alloy is then permeated into a filling-up layer of the sintered hard substance grains. The mold member is thereafter removed and the exposed surface is polished to obtain a fine wear-resistant layer on the base member.

8 Claims, 4 Drawing Sheets

METHOD OF FORMING WEAR-RESISTANT LAYER

BACKGROUND OF THE INVENTION

This invention relates to a method for forming a wear-resistant layer on a surface of a metallic material such as, particularly, an inner surface of a cylinder or barrel, which is liable to wear, used for a plastic forming machine or a ceramic forming machine.

Conventionally, formation of a wear-resistant layer of this character has been carried out by methods including a method of surface nitriding treatment and a method of adopting a lining of wear resistant alloy formed by spray coating, building up, or centrifugal casting on the surface of a metallic material on which wear-resistant layer is formed. According to these conventional methods, however, it is considerably difficult to form the wear-resistant layer uniformly on the surface of an object which has a large dimension and on the inner surface of a hollow material having a small inner dimension, and, furthermore, a lined layer is liable to come off. Therefore, these methods are not satisfactory because of problems in the performance of the layer and the process of forming the same. There has also been proposed another method for eliminating the defects of the methods described hereinbefore, in which a wear-resistant layer is formed by bringing hard substance powde such as tungsten (WC) powder into contact with a base material or member directly or indirectly through an auxiliary layer, such as a partition plate made of an easily soluble material, interposed between the WC powder and the base member to form a filling-up layer, and by permeating melt of metal such as nickel (Ni)-based or cobalt (Co)-based self-melting alloy into the filling-up layer so as to disperse the fine grains of the hard substance such as WC into the metal. The thus formed wear-resistant layer is highly improved in the wear resisting property, and the metal can comparatively easily permeate through the filling-up layer if the filling-up layer of hard substance powder is formed by employing a suitable mold such as a core so that it is possible for this type of layer to be applied to the surfaces of base members having various outer configurations. If the thickness of this type of wear-resistant layer is increased, small vacancies or empty holes may be formed in the layer, which is considered to be caused by the contraction which occurs when the hard substance powder and the metal are sintered. When the thickness of the wear-resistant layer is 2 to 3 mm, vacancies having diameter of about 10 to 100 microns may be formed. In case the vacancies are extremely small in size, no substantial problem is caused, and the existence of such vacancies does not provide any problem or it is rather preferable since lublicating oil enters into the vacancies when, for example, they are formed in slide surfaces of machine tools. However, in the case of the inner surface of a cylinder of a plastic making machine, plastic enters into vacancies and stagnates in the same so that it is peeling off after being heated and burnt to be mixed into normal plastic.

SUMMARY OF THE INVENTION

An object of this invention is to eliminate the defects in prior art and to obtain a wear-resistant layer on a surface of a metal member with substantially no vacancies therein.

According to this invention, this and other objects can be achieved by providing a method for forming a wear-resistant layer wherein a base member having a surface on which a wear-resistant layer is formed and a mold member are located in opposed relation so as to form a gap between the wear-resistant layer forming surface and the opposing surface of the mold member, the gap is filled with sintered hard substance grains a principal component of which is a hard substance powder along the wear-resistant layer forming surface of the base member, and a selected metal is then permeated into a filling-up layer of the sintered hard substance grains. In another aspect of this invention, instead of only the sintered hard substance grains, a hard substance powder is filled in the gap together with the sintered hard substance grains of the hard substance powder.

In addition, in accordance with the present invention, a preliminary treatment for intensifying the bonding on the surface of the base member on which a wear-resistant layer is to be formed may be effected or may not be effected.

Carbides, nitrides and borides of metals belonging to the groups IV, V and VI of the periodic table such as WC, VC, $TiB_2$, MoB, TiN, ZrN, and so forth are suitable for the hard substance powder, and powder of a particle size less than several microns is preferably used in terms of the full dispersion of the hard substance powder into the wear-resistant layer.

The main component of the sintered hard substance grains is the above-described type of powder, and this powder is mixed with metal powder formed from a simple substance or a suitable mixture of Co, Ni and/or Fe (substantially the same particle size as that of the hard substance powder) at a ratio of 95% with respect to the former and 5% with respect to the latter, thereby obtaining sintered material. This sintered material is used after being pulverized and classified by a screen. The particle size of this sintered hard substance grains is preferably 50 to 150 microns with a view to substantially eliminating vacancies in the wear resistant layer and to disperse the hard substance more uniformly.

Metal which is to be permeated into the sintered hard substance grain is selected from metals having a melting point lower than those of the base member and the sintered hard substance grains and preferably having corrosion and/or wear resisting properties. This metal may preferably be a Ni-based or Co-based self-melting alloy. Also this metal may be one that, together with the metal contained in the sintered hard substance grains, forms an alloy having corrosion and/or wear resisting properties.

DESCRIPTION OF THE PREFERRED EMBODIMENT

Figure 1:
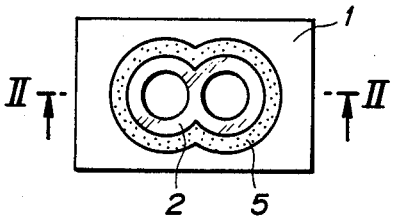
FIG. 1 is a plan view of a base member and a mold (core) employed for Reference Example and Example of the present invention, hard substance powder or sintered hard substance grains being packed between the base member and the core.

In advance of the description of the embodiment of this invention, a conventional wear-resistant layer forming method will be first described hereunder as a Reference Example in conjunction with the drawing attached for easy understanding of the present invention. In the Reference Example and the Preferred Example of this invention, a wear-resistant layer forming method is referred to the case where a base material is a cylinder or barrel (in FIG. 1, the base member being rectangular in cross section) for a twin-screw type plastic forming machine. It should be however noted, as described hereinlater, that the wear-resistant layer forming method of the present invention can be applied to form the same on a flat plate surface, inner surfaces of cylinder members for various types of forming machines, and outer surfaces of screw members of the forming machines.

(REFERENCE EXAMPLE)

As shown in FIG. 1, a base member 1 for use as a cylinder or barrel of a twin-screw type plastic making machine was used. A core 2 was disposed as a mold in the base member to form a wear-resistant layer 7 (refer to FIG. 4), which is described later, on the inner surface 1a of the base member 1, and a gap 3 into which WC powder 5 provided as the hard substance powder was packed was formed between the inner surface 1*a* of the base member 1 and the outer peripheral surface 2*a* of the core 2. The lwoer end of the gap 3 was closed by a welded portion 4. The length l of the gap 3 was 200 mm, the diameter D of the core 2 was 50 mm, the diameter of the inner surface 1a of the base member 1 was selected to set the thickness t of the gap 3 at 3 mm. In order to form the gap 3 it is preferable to use a core 2 provided with a flange portion at the bottom end thereof.

Figure 3:
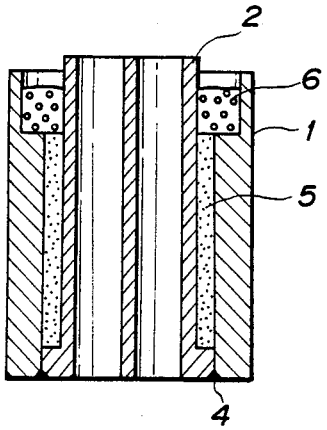
FIG. 3 is a longitudinal-sectional view of the sate of fine particles of alloy which is placed on the material shown in FIG. 2 before the alloy is permeated.

The WC powder 5 having a particle size of about 10 microns was packed as the hard substance powder into the gap 3 by employing a shaker (not shown in the drawings). As shown in FIG. 3, fine particles 6 of a Ni-based self-melting alloy were placed on the gap 3. These materials were heated at 1080° C. in 20 minutes in a vacuum furnace at a degree of vacuum of 0.55 Torr. The fine particles 6 of Ni-based self-melting alloy were thereby fused and permeated into the WC powder 5, that is, into the gap 3, and these materials were thereafter cooled to the room temperature in the same vacuum furnace.

Table 1 shows the composition of the above-described Ni-based self-melting alloy.

TABLE 1

| (% by weight) | | | | | | |
|---|---|---|---|---|---|---|
| Ni | Cr | B | Si | Fe | C | P |
| Balance | 7.2 | 3.1 | 4.5 | 3.1 | less than 0.15 | — |

Figure 4:
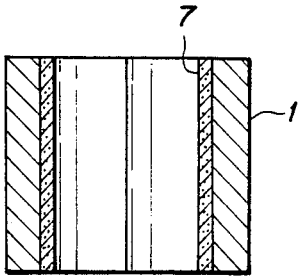
FIG. 4 is a longitudinal-sectional view of the state in which the opposite ends of the mold (core) and the base member are cut and removed after a wear-resistant layer has been formed on the inner surface of the base member shown in FIGS. 1 to 3.

The opposite vertical ends, as viewed, of the base member 1 were cut and removed by machining, the core 2 is then removed, and the exposed inner surface of the base member was polished so that a wear-resistant layer 7 formed in the gap 3 was exposed to the internal space of the base 1, as shown in FIG. 4.

Figure 5:
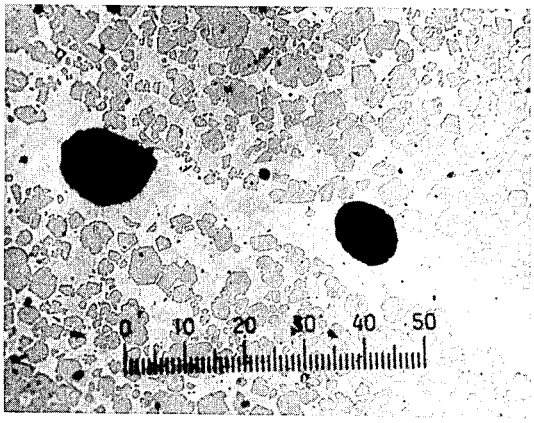
FIG. 5 is a microphotograph of a section of the wear-resistant layer formed in the Reference Example (magnification: 400)

When a section of the wear-resistant layer 7 thus formed was observed by a microscope, vacancies were recognized as indicated by the black spots in the photograph of FIG. 5 (magnification: 400). The diameter of each of these vacancies was about 20 to 40 microns, and six vacancies existed in a volume of 1 $cm^2$.

(PREFERRED EXAMPLE OF THE INVENTION)

Figure 2:
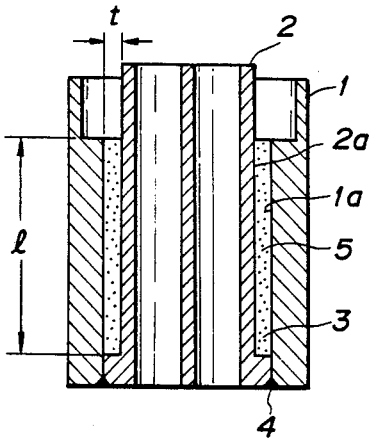
FIG. 2 is a longitudinal-sectional view taken along a line II—II of FIG. 1.

The procedures were the same as those of the above Reference Example except for packing the following sintered hard substance grains instead of the hard substance powder 5 into the gap 3 shown in FIGS. 1 and 2.

WC powder having a particle size of about 1 micron and Co powder having a particle size of 1.5 micron were weighed and pulverized to be mixed at a ratio of 95% by weight with respect to the former and 5% by weight with respect to the latter. Sintered material of WC-Co formed therefrom was pulverized and classified by the screen to obtain sintered hard substance grains having a particle size of 50 to 150 microns to be used.

These sintered hard substance grains were packed into the gap 3 as shown in FIGS. 1 and 2 by employing the shaker. The procedures which followed wre effected in the same conditions as those of the Reference Example described above, thus forming a cylinder such as shown in FIG. 4.

Figure 6:
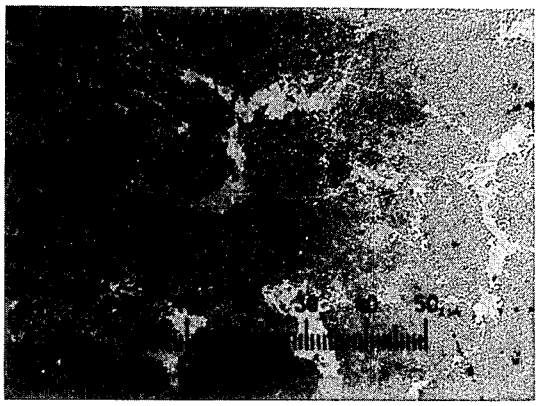
FIG. 6 is a microphotograph of a section of the wear-resistant layer formed in the Example in accordance with the present invention (magnification: 400)
Figure 7:
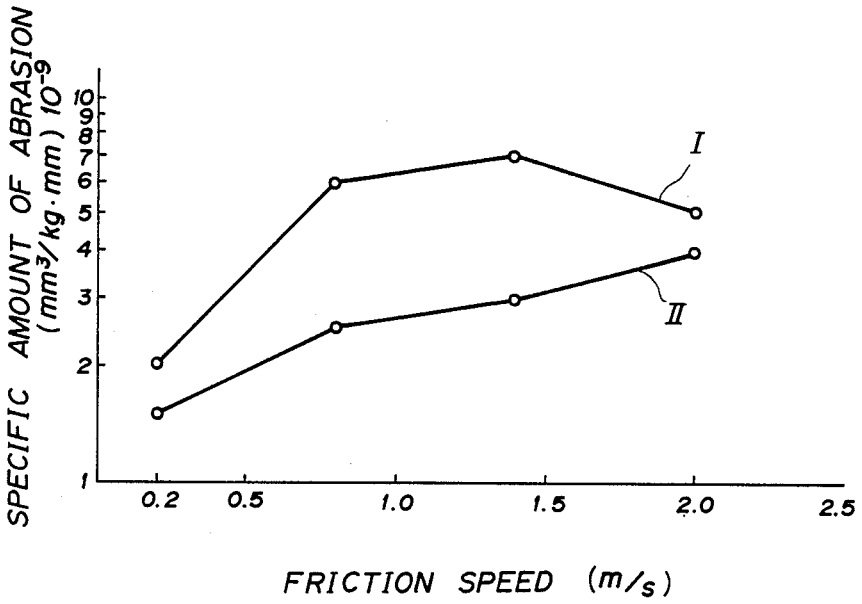
FIG. 7 is a graph showing the results of the abrasion test of the wear-resistant layer formed in the Reference Example and the Example of the present invention.

FIG. 6 shows a photograph of an enlarged section (magnification: 400) of the wear-resistant layer obtained in this example. As is clear from this photograph, substantially no vacancy is observed and finer WC (hard substance) is uniformly dispersed. FIG. 7, shows the amount of abrasion as the results of test carried out by employing a Oogoshi type abrader with respect to the wear resistant layers of the Reference Example and the Example in accordance with the present invention. The testing member of the abrasion test is SKD 11 (metal steel based on Japanese Industrial Standard) ($H_RC58$) (symbol showing the Rockwell Hardness), the abrasion distance is 600 m, pressing load is 1.89 kgf, and the specific amount of abrasion is an amount of abrasion at an abrasion distance of 1 m and a pressing load of 1 kgf. In FIG. 7, the line I represents the result based on the Reference Example and the line II represents the result of the Example of this invention.

As is apparent from FIG. 7, the Example of the present invention is also superior to the Reference Example in terms of the wear resisting property.

In the preferred embodiment of this invention, since the sintered hard substance grains filling the surface of the base member on which the wear-resistant layer is to be formed are formed to have a high degree of density and comparatively large particle size, thus increasing the filling-up density compared with a case in which powder having particle size of several microns is used, in the same form, to fill the surface. When a melt of metal such as described above is permeated into the sintered hard substance grains, this melt can be more fully permeated through the sintered hard substance grains. Therefore, when the melt of the metal is permeated and sintered, the degree of contraction due to the sintering is limited to a very small level so that there is no substantial risk of generating vacancies, which may lead to the defect for a product, as in the case of the abovedescribed proposition in which hard substance powder is directly packed without being formed to be grains by sintering. Moreover, since the sintered hard substance grains are uniformly packed at a high degree of density, the hard substance can be dispersed more uniformly.

Hard material powder which has not been sintered with the sintered hard substance grains may be packed into the gaps between the sintered hard substance grains so that the powder additionally exists in the gaps. In that case, the sintered hard substance grains and the hard substance powder may be packed after being sufficiently mixed by means of a powder mixer. This method can also provide a wear-resistant layer similar to that formed in the above-described manner, which is free from vacancies, having a high degree of density of the hard substance and, hence, highly improved in the wear resisting property.

The present invention makes it possible to eliminate vacancies in the wear-resistant layer, more uniformly disperse the hard substance into the wear-resistant layer, and increase the content of the hard substances, thereby realizing a superior wear-resistant property.

Although in the foregoing Reference Example and the Preferred Example of this invention, the wear-resistant layer forming method is adopted to the outer surface of the base member for the barrel of the twin-screw type plastic forming machine, the method can be applied, as described hereinbefore, to the base materials for the cylinder of a single screw type plastic forming machine and the screw of the machine of this type as well as the formation of the wear-resistant layer on the surface of a flat metal plate. These applications will be briefly described hereunder with reference to FIGS. 8 through 10.

Figure 8:
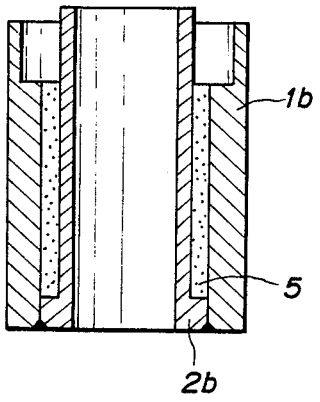
FIGS. 8 through 10 show longitudinal sectional views similar to FIG. 2, in which the method of forming a wear-resistant layer of this invention can be applied to various types of base members on the surface of which the layers are to be formed.

FIG. 8 shows a longitudinal section similar to FIG. 2, which explains a method of forming a wear-resistant layer on an inner surface of a base member 1*b* of a cylinder of a single screw type plastic forming machine and in which wear-resistant layer forming conditions are substantially the same as those shown in FIG. 2 except that a cylinder 1*b* is used in substitution for a rectangular barrel 1 and a core 2*b* having a shape suitable for the single screw is used.

Figure 9:
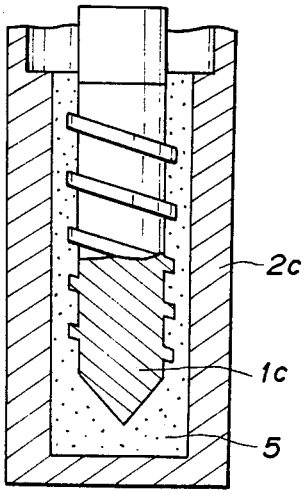

FIG. 9 also shows a longitudinal section, partially not section, similar to FIG. 8, which explains a method of forming a wear-resistant layer on an outer surface of a screw 1*c* as a base member of the plastic forming machine and in which an outer frame member 2*c* is located to surround the screw 1c so as to form an annular gap therebetween which is filled with sintered hard substance grains 5 for forming the wear resistant layer.

Figure 10:
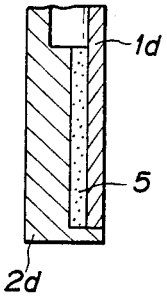

FIG. 10 also shows a longitudinal section, which explains a method of forming a wear-resistant layer on a surface of a flat metal plate 1*d* and in which an outer frame 2*d* is located so as to form a gap between the frame 2*d* and the plate 1*d*. The gap is filled with the sintered hard substance grains 5. The frame 2*d* can be of course located on the other surface side if the formation of the wear-resistant layer is required for the other surface of the plate.

Apart from the Examples described hereinbefore, according to this invention, the shapes and locations of the core members or frames are not limited to the types described, and with all of these Examples, the cores or frames can be easily removed by preliminarily applying a parting agent on the surface contacting the sintered hard substance grains.

What is claimed is:

1. A method of forming a wear-resistant layer comprising the steps of:

preparing a cylinder or screw of a molding machine as a base member having a surface on which a wear-resistant layer is formed and a mold member to be located in opposing relation to said base member so as to form an even gap between the surface of said base member and the opposing surface of said mold member;

filling said gap along said wear-resistant layer forming surface of said base member with sintered hard substance grains a principal component of which is hard substance powder formed by one or more kinds of materials selected from carbides, nitrides and borides of metals belonging to groups IV, V and VI of the periodic table; and permeating fused metal having a melting point lower than those of said base member and said sintered hard substance grains into a filling-up layer of said sintered hard substance grains.

2. The method according to claim 1 wherein said sintered hard substance grains are a mixture of sintered grains formed from said hard substance powder and one to three materials selected from cobalt, nickel and iron.

3. The method according to claim 1 wherein said metal is one selected from a nickel-based self-melting alloy and a cobalt-based self-melting alloy.

4. A method of forming a wear-resistant layer comprising the steps of:

preparing a base member having a surface on which a wear-resistant layer is formed and a mold member to be located in opposing relation to said base member so as to form a gap between said surface of the base member and the opposing surface of said mold member;

filling said gap along said wear-resistant layer forming surface of said base member with sintered hard substance grains, the particle size of which is in the range of 50 to 150 microns and a principal component of which is hard substance powder, the particle size of said powder being less than several microns, said powder being formed from one or more kinds of materials selected from carbides, nitrides and borides of metals belonging to groups IV, V and VI of the periodic table; and permeating fused metal having a melting point lower than those of said base member and said sintered hard substance grains into a filling-up layer of said sintered hard substance grains.

5. A method for forming a wear-resistant layer comprising the steps of:

preparing a cylinder or screw of a molding machine as a base member having a surface on which a wear-resistant layer is formed and a mold member to be located in opposing relation to said base member so as to form an even gap between the surface of said base member and the opposing surface of said mold member;

filling said gap along said wear resistant layer forming surface of said base member with a hard substance powder formed by one or more kinds of materials selected from carbides, nitrides and borides of metals belonging to groups IV, V and VI of the periodic table and sintered hard substance grains a principal component of which is said hard substance powder; and permeating fused metal having a melting point lower than those of said base member and said sintered hard substance grains into a filling-up layer of said hard substance powder and said sintered hard substance grains.

6. The method according to claim 5 wherein said sintered hard substance grains are a mixture of sintered grains formed from said hard substance powder and one to three materials selected from cobalt, nickel and iron.

7. The method according to claim 5 wherein said metal is one selected from a nickel-based self-melting alloy and a cobalt-based self-melting alloy.

8. A method for forming a wear-resistant layer comprising the steps of:

preparing a base member having a surface on which a wear-resistant layer is formed and a mold member to be located in opposing relation to said base member so as to form a gap between said surface of the base member and the opposing surface of said mold member;

filling said gap along said wear-resistant layer forming surface of said base member with a hard substance powder, each particle size of which is less than several microns, formed by one or more kinds of materials selected from carbides, nitrides and borides of metals belonging to groups IV, V and VI of the periodic table and sintered hard substance grains each particle size of which is 50 to 150 microns and a principal component of which is said hard substance powder; and permeating fused metal having a melting point lower than those of said base member and said sintered hard substance grains into a filling-up layer of said hard substance powder and said sintered hard substance grains.

* * * * *